US005916038A

United States Patent [19]

Uchiyama et al.

[11] Patent Number: 5,916,038

[45] **Date of Patent: *Jun. 29, 1999**

[54] GOLF WOOD CLUB

[75] Inventors: Mitsuru Uchiyama, Tokyo; Mitsuo Ohtani, Kawachinagano; Mica Nukina, Kawasaki; Atsushi Uchiyama, Tokyo, all of Japan

[73] Assignee: Mitsuko Uchiyama, Tokyo, Japan

[ * ] Notice: This patent is subject to a terminal disclaimer.

[21] Appl. No.: 08/957,102

[22] Filed: Oct. 24, 1997

[30] Foreign Application Priority Data

| | | | |
|---|---|---|---|
| Oct. 29, 1996 | [JP] | Japan | 8-303600 |
| Dec. 4, 1996 | [JP] | Japan | 8-338999 |
| Jan. 10, 1997 | [JP] | Japan | 9-014604 |
| Jul. 28, 1997 | [JP] | Japan | 9-217080 |

[51] Int. Cl.[6] ..... A63B 53/08

[52] U.S. Cl. ..... 473/290; 473/291; 473/324

[58] Field of Search ..... 473/290, 291, 473/292, 324; 273/77 A, 77 R, 80 R

[56] References Cited

U.S. PATENT DOCUMENTS

| | | | |
|---|---|---|---|
| 4,261,566 | 4/1981 | MacDougall | 473/291 |
| 5,478,073 | 12/1995 | Hackman | 473/292 |

*Primary Examiner*—Kien T. Nguyen

*Attorney, Agent, or Firm*—Frishauf, Holtz, Goodman, Langer & Chick

[57] ABSTRACT

(1) A golf wood club having a loft angle of 16 degrees or less, a head volume V of 270 to 450 ml, a head weight G of 160 to 195 g, and a shaft length S of 120 cm or more, the shaft length S being in the range expressed by the following inequality:

$$315.8-1.023G \leqq S \leqq 327.8-1.023G;$$

and (2) a golf wood club having a loft angle in the range of 15 to 20 degrees, a face height of 30 to 40 mm, a head volume V of 180 to 300 ml, a head weight G of 170 to 200 g, and a shaft length S of 120 cm or more, the shaft length S being in the range expressed by the following inequality:

$$315.8-1.023G \leqq S \leqq 327.8-1.023G.$$

The golf wood clubs do not show decrease in the reproducibility of good shot although the club has a length of 120 cm or more, preferably 125 cm or more.

12 Claims, 3 Drawing Sheets

GOLF WOOD CLUB

FIELD OF THE INVENTION

The present invention relates to a golf wood club which enables increase in the distance of shot and gives excellent reproducibility of good shot.

PRIOR ART OF THE INVENTION

Golfers have heretofore been interested in increasing the distance of shot when a driver club is used. Therefore, development of a driver club giving an increased distance of shot has always been desired.

Increasing the shaft length is considered as a natural physical principle for increasing the distance of shot. However, increase in the shaft length causes extremely inferior reproducibility of good shot by a driver club. Therefore, no driver clubs having a length of 48 inches or more have been available in the market or have actually been used.

No fairway wood clubs having a length of 48 inches or more have actually been used, either. Even a fairway wood club having a length of 43 inches or more has not been used actually.

SUMMARY OF THE INVENTION

The present invention has an object of providing a wood club of the driver type (hereinafter, occasionally referred to as a driver club) which is prepared in accordance with a specific philosophy of design and maintains excellent reproducibility of good shot although the driver club has a length of 120 cm (about 47 inches) or more, preferably 125 cm or more. The present invention has another object of providing a long wood club for fairway (hereinafter, occasionally referred to as a fairway wood club) which is prepared in accordance with the above philosophy of design and has a length of 120 cm (about 47 inches) or more, preferably 125 cm or more, more preferably 129.5 cm or more.

Thus, the present invention provides:

A golf wood club having a loft angle of 16 degrees or less, a face height of 40 mm or more, a head volume V of 270 to 450 ml, a head weight G of 160 to 195 g, and a shaft length S of 120 cm or more, the shaft length S being in the range expressed by following inequality (A):

$$315.8-1.023G \leqq S \leqq 327.8-1.023G \quad \text{(A)}$$

and

A golf wood club having a loft angle in the range of 13 to 21 degrees, a face height of 30 to 40 mm, a head volume V of 150 to 300 ml, a head weight G of 170 to 200 g, and a shaft length S of 120 cm or more, the shaft length S being in the range expressed by following inequality (D):

$$315.8-1.023G \leqq S \leqq 327.8-1.023G \quad \text{(D).}$$

DETAILED DESCRIPTION OF THE INVENTION

Figure 1:
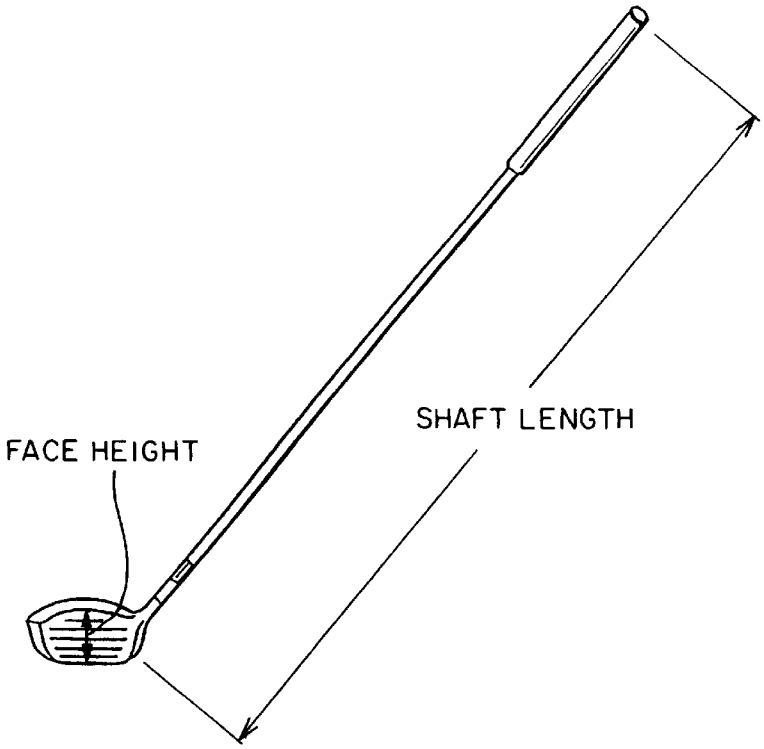
FIG. 1 shows a perspective view of the driver club of the present invention.

It is well known that the head speed of a club is increased and the distance of shot is also increased when a shaft of a wood club, such as a driver club, has a greater length.

The initial speed of a golf ball v is decided by the head weight M and the head speed V of a driver club. This relation can be expressed by the following equation:

$$v = \frac{M}{M+46}(1+E)V$$

In the above equation, E represents resilience of a ball, and the number 46 shows the weight of a golf ball which is 46 g. Because the resilience of a golf ball is considered to be about 0.8 when the ball is hit by a driver club at a head speed of 45 m/sec, the above equation can approximately be replaced by the following equation:

$$v = 1.8\frac{M}{M+46}V$$

This equation shows that the initial speed of a ball v increases proportionally to the head speed but does not sharply change with the change in the head weight M because M is present in both numerator and denominator in the equation. The head speed increases with increase in the shaft length. Therefore, the above equation shows that the initial speed of a ball does not decrease much with decrease in the head weight, and that the head speed increases with increase in the shaft length, and, in turn, the initial speed of a ball increases proportionally to the increase in the head speed.

The head weight is assumed to be 200 g. When the head weight is around 200 g, the initial speed of a ball is expressed by the following equation:

$$v=1.46V$$

The above equation means that the initial speed of a ball increases by about 1.5 m/sec when the head speed increases by 1 m/sec.

The basic principle of the present invention is that the head speed V of a club is increased by increasing the shaft length and decreasing the head weight which does not affect the initial speed of a ball v much, and the initial speed of a ball v is increased by the increase in the head speed V.

On the other hand, it is also known that the reproducibility of good shot by a driver club becomes markedly inferior when the shaft length is simply increased.

For analysis of the reproducibility of shot by a driver club, reproducibility of hitting a ball exactly at the sweet spot (center of percussion) and the reproducibility of the direction of flight of the ball must be considered separately.

When the shaft length is increased while the head weight is kept the same, the longer driver club cannot be swung by the same force as that for the original club. When the weight of a driver club is greater than the weight suitable for the ability of a golfer, the reproducibilities of swing and the head speed of such a club become markedly inferior.

As the result of intensive studies on many driver clubs having good reproducibility, the present inventors found that a driver club having a length of 48 inches or more, particularly 50 inches or more, can be obtained without decreasing the reproducibility of shot from that of a driver club having a smaller length of 45 inches or less when a specific head volume and a specific head weight are selected. The present invention has been completed on the basis of this knowledge.

In the present invention, a wood club is a club having a shape in which the length of the sole part perpendicular to the face is longer than the face height, and the material used for the head is not particularly limited.

In the present invention, the loft angle is defined as follows. A club is disposed at the position of addressing in which the face of the head is disposed toward the direction of the target. More specifically, the sole of the head is disposed in the horizontal direction, the face of the head is disposed in such a manner that a line perpendicular to the face is kept to the direction of the flight of a ball when the line is seen at a position directly above the head, and the axis line of the shaft is disposed in a vertical plane. The loft angle is defined as the angle between the plane of the face and the above vertical plane in which the central line of the shaft is disposed. The above loft angle is the so-called real loft.

In the present invention, the shaft length is the length from the grip end to the intersection of a line extended from the axis line of the shaft with the plane of the floor when the club is addressed to the floor in an ordinary form.

As the result of intensive mechanical and geometrical studies by the present inventors on driver clubs having a loft angle of 16 degrees or less, preferably 14.5 degrees or less, and a large face height, it was found that, when a club is designed in such a manner that the shaft length, the head volume, and the head are is kept in a specific relation, a driver club showing excellent reproducibility of shot can be obtained while the distance of shot is increased by increasing the shaft length. The driver club of the present invention has been completed on the basis of this knowledge.

It was also found that, when the technical philosophy of the driver club of the present invention is applied to a fairway wood club having a loft angle of 13 to 21 degree, preferably 15 to 20 degrees, the face height and the relations of the shaft length to the head volume and the head weight for a fairway wood club must be modified from those for a driver club by considering the effect of increase in the loft angle and modes of use entirely different from that of a driver club. The fairway wood club of the present invention has been completed on the basis of this knowledge.

Accordingly, the present invention provides the following individual inventions. As shown in the following, the individual inventions are classified into two types of wood club in accordance with the face height.

(a) Wood clubs of the driver type (1) A golf wood club having a loft angle of 16 degrees or less, preferably 14.5 degrees or less, a face height of 40 mm or more, preferably 45 mm or more, a head volume V of 270 to 450 ml, a head weight G of 160 to 195 g, and a shaft length S of 120 cm or more, the shaft length S being in the range expressed by following inequality (A):

$$315.8-1.023G \leqq S \leqq 327.8-1.023G \quad \text{(A)}$$

(2) A golf wood club described in (1), which has a shaft length of 125 cm or more, preferably 130 cm or more, a head volume V of 270 to 450 ml, and a head weight G of 160 to 193 g;

(3) A golf wood club described in (1), which has a shaft length of 137.5 cm or more, preferably 140 cm or more, more preferably 142 cm or more, a head volume of 300 to 450 ml, and a head weight G of 160 to 185 g;

(4) A golf wood club described in any of (1), (2), and (3) which has a shaft length S in the range expressed by following inequality (B):

$$318.8-1.023G \leqq S \leqq 324.8-1.023G \quad \text{(B)}$$

(5) A golf wood club described in any of (1), (2), (3), (4), which has a shaft length S in the range expressed by following inequality (C):

$$S \leqq 170\ (V/200)^{1/3}-55 \quad \text{(C)}$$

and (6) A golf wood club described in any of (1), (2) (3), (4), and (5), wherein a shaft obtained by removing a part of 30 cm at the grip end of the original shaft has a weight of 70 g or less.

(b) Wood clubs for fairway (7) A golf wood club having a loft angle in the range of 13 to 21 degrees, preferably 15 to 21 degrees, a face height of 30 to 40 mm, preferably 30 to 36 cm, a head volume V of 150 to 300 ml, preferably 180 to 300 ml, a head weight G of 170 to 200 g, and a shaft length S of 120 cm or more, preferably 125 cm or more, more preferably 129 cm or more, the shaft length S being in the range expressed by following inequality (D):

$$315.8-1.023G \leqq S \leqq 327.8-1.023G \quad \text{(D)}$$

(8) A golf wood club described in (7), which has a shaft length in the range expressed by following inequality (E):

$$318.8-1.023G \leqq S \leqq 324.8-1.023G \quad \text{(E)}$$

(9) A golf wood club described in any of (7) and (8), which has a shaft length in the range expressed by following inequality (G):

$$S \leqq 170\ (V/200)^{1/3}-40 \quad \text{(G)}$$

and

(10) A golf wood club described in any of (7), (8), and (9), wherein a shaft obtained by removing a part of 30 cm at the grip end of the original shaft has a weight of 70 g or less.

As a preferable embodiment of the present invention, a club having a rubber grip around which a tape of a soft synthetic resin is wound is preferable. A golfer can easily swing the club of this embodiment of the present invention.

The above wood club of type (a) can be used as the driver club, and the above wood club of type (b) can be used as a fairway wood club.

The driver club of the present invention has a loft angle of 16 degrees or less, preferably 13 degrees or less; a face height of 40 mm or more, a head volume V of 270 to 450 ml, preferably 300 to 450 ml; a head weight G of 160 to 195 g, preferably 160 to 193 g, more preferably 160 to 185 g; and a shaft length S of 120 cm or more, 125 cm or more, 137.5 or more, preferably 140 cm or more, or more preferably 142 cm or more, depending on the ranges of the head weight and the head volume. The shaft length S is in the range expressed by following inequality (A):

$$315.8-1.023G \leqq S \leqq 327.8-1.023G \quad \text{(A)}$$

preferably by following inequality (B):

$$318.8-1.023G \leqq S \leqq 324.8-1.023G \quad \text{(B)}$$

A more advantageous club can be obtained when following inequality (C) is satisfied:

$$S \leqq 170\ (V/200)^{1/3}-55 \quad \text{(C)}$$

The basic constitution of the golf wood club of the present invention is based on the technical philosophy that, to enable the increase in the shaft length, the head weight is decreased in accordance with the rule of mechanics which is applicable to the particular shaft length, and the head volume is increased in accordance with the geometrical calculation which is applicable to the particular shaft length.

In accordance with the above basic constitution, the club which gives a remarkably increased distance of shot and no decrease in the reproducibility of good shot and is particularly advantageous as the driver club is, for example, a golf wood club which has a loft angle of 13 degrees or less, preferably 12 degrees or less, a shaft length of 142.5 to 160 cm, a head volume of 350 to 450 ml, a head weight G of 177 g or less, and a shaft length S satisfying inequality (A), preferably inequality (B), more preferably inequality (C).

When the shaft length is more than 160 cm, the relation between the head weight and the shaft length which is the basis for the above inequalities does not hold, and another relation must be obtained by experiments.

The club which shows remarkably increased distance of shot and no decrease in the reproducibility of good shot and is advantageous as the driver club of the present invention next to the club described above is, for example, a golf wood club which has a loft angle of 13.5 degrees or less, a shaft length of 127 to 142.5 cm, a head volume of 270 to 350 ml, and a head weight G of 177 to 190 g or less, and a shaft length S satisfying inequality (A), preferably inequality (B), more preferably inequality (C).

It is one of the characteristics of the present invention that the shaft length is decided in accordance with the loft angle, the head weight, and the head volume.

The above basic constitution of the present invention is applied to the fairway wood club as following.

The fairway wood club of the present invention has a loft angle in the range of 13 to 21 degrees, a face height of 30 to 40 mm, preferably 30 to 36 mm, a head volume V of 150 to 300 ml, preferably 180 to 250 ml, a head weight G of 170 to 200 g, and a shaft length S of 120 cm or more, the shaft length S being in the range expressed by following inequality (D):

$$315.8-1.023G \leqq S \leqq 327.8-1.023G \quad \text{(D)}$$

preferably by following inequality (E):

$$318.8-1.023G \leqq S \leqq 324.8-1.023G \quad \text{(E)}$$

more preferably by following inequality (G):

$$S \leqq 170\ (V/200)^{1/3}-55 \quad \text{(G)}$$

When a driver club has a loft angle exceeding 15 degrees and a shaft length of 120 cm or more, a ball takes an excessively high trajectory. Therefore, increase in the distance of shot cannot be expected, and the accuracy of the distance is markedly decreased.

A fairway wood club having a loft angle exceeding 21 degrees shows the same phenomenon.

The wood club of the present invention has a shaft length of 120 cm or more, 125 cm or more, preferably 127 cm or more, more preferably 130 cm or more, 137.5 cm or more, preferably 140 cm or more, more preferably 142 cm or more, depending on the shape of the head and the ranges of the head weight and the head volume. When the shaft length is outside the above ranges, the distance of shot is not remarkably greater than that obtained by using conventional clubs.

In the fairway wood club of the present invention, it is necessary that the face height be 40 mm or less, preferably 38 mm or less, more preferably 35 mm or less. When the club has a thin face as specified above, the face area of the head seen at a position directly above the head is increased although the head volume is as small as 200 ml, i.e., smaller than that of the club of the driver type, and the sweet area is expanded in the horizontal direction. Because the fairway wood club is used without placing a ball on a tee, hitting at a position above or below the sweet area inevitably produces a mistaken shot. Therefore, expansion of the sweet area in the vertical direction does not show advantage unlike the driver club although expansion of the sweet area in the transverse direction has the advantage.

Because the dimension of the face of the head seen at a position directly above the head is greater in the transverse direction and in the longitudinal direction due to the decreased thickness of the head as described above, the moment of inertia of rotation given to the head by the impact of a ball is increased, and controllability of the direction of shot is increased. Moreover, the dimension of the face of the head in the horizontal direction is increased and the depth of the center of gravity is also increased because the distance between the center of gravity and the surface is increased. These factors in addition to the loft angle larger than the driver club increase controllability of the direction of shot and the dimension of the sweet area. Therefore, the shaft length relative to the head volume can be increased to an extent greater than that for the driver club.

To satisfy the requirements of a larger volume and a less weight for the club of the present invention, it is inevitable that the club head has a hollow structure or a hollow structure filled with a foamed material.

In the present invention, the face height is defined as the maximum height of the front face which does not include curved parts at the upper front part or the sole of the head.

The basic constitution of the driver club of the present invention is, as described above, based on the technical philosophy that the head weight is decreased to increase the shaft length in accordance with the rule of mechanics which is applicable to the particular shaft length, and the head volume is increased.

For example, when a wood club having a shaft length of 51 inches (about 130 cm) has a head weight exceeding 195 g, swing of the club becomes inaccurate with use of an ordinary power of swing, and an accurate shot becomes difficult.

When a driver club has a head volume less than 270 ml, hitting a ball by the club at the sweet area becomes difficult. In other words, the probability of hitting a ball at the sweet spot is decreased.

On the other hand, when a fairway wood club of type (b) is used, the sweet area is substantially increased by the increased loft angle, and the club may have a head volume smaller than that of the driver club. However, the probability of hitting a ball at the sweet spot is decreased unless the head has a volume of 200 ml or more when the shaft length is 120 cm or more.

The head volume is the volume of the head which remains after the shaft is disconnected at the connecting part at the upper part of the head of the wood club. When a portion of the upper part of the head is absent, the head volume is obtained from a hypothetical curved surface formed from the upper edge of the face and the peripheral parts of the head.

The present inventors first paid their attention to the fact about driver club that the dimension of the sweet area of the clubs of this type is proportional to the dimension of the head.

The sweet area is defined as the area on the face of a club which gives a distance of shot shorter than the maximum distance of shot by 10 yards or less. The maximum distance of shot is the distance obtained by hitting a ball exactly at the sweet spot of the club. The sweet area can be clearly defined by specifying the decrease in the distance of shot as described above.

Results of the measurements of shot by professional golfers using driver clubs showed that the distance of shot is decreased by about 10 yards when a ball is hit at a position at a distance of 1 cm from the sweet spot, and by about 30 yards when a ball is hit at a position at a distance of 2 cm from the sweet spot. The driver clubs used in the measurement had small head volumes of 200 ml or less.

The present inventors paid their attention to the fact that the distance error between the position of hitting and the sweet spot is proportional to the distance between the eyes of a golfer and a ball. It is generally considered that the distance error between the position of hitting and the sweet spot is proportional to the shaft length. One of the characteristics of the present invention comes from the knowledge that the distance error between the position of hitting and the sweet spot is proportional to the distance between the eyes and a ball.

The distance between the eyes of a golfer and a ball is increased when the shaft length is increased. However, it was found that the reproducibility of good shot by a driver club is maintained when the dimension of the head is increased in proportion to the increase in the distance between the eyes of a golfer and a ball.

A driver club having an ordinary head volume of 200 ml and a shaft length of 44 inches (110 cm) is taken as an example of conventional clubs and used as the reference in the following.

When a ball is hit by this driver club, results of measurements showed that the average distance between the eyes and a ball is about 170 cm although the distance is different depending on the height of a golfer.

The distance between the eyes and a ball is about 170+s cm when the shaft is increased by s cm.

Therefore, the reproducibility of shot in which a ball is hit at the sweet area by a driver club should not be decreased when the dimension of the head is increased to the original dimension multiplied by [(170+s)/170].

The head volume of a driver club is represented by V, and a driver club having a head volume of 200 ml is used as the reference. Because the dimension is proportional to the cubic root of the volume, the head volume V having the dimension which can maintain the reproducibility of shot produced by hitting a ball at the sweet area at the same level as the reproducibility obtained using a driver head having a volume of 200 ml is expressed by the following equation:

$$(170+s)/170=(V/210)^{1/3}$$

After rearranging the above equation, s is expressed by the following equation:

$$s=170\ (V/200)^{1/3}-170$$

Because the shaft length S of the driver club is obtained by adding s to 44 inches (110 cm), the length S is expressed by the following equation:

$$S = 110 + 170(V/200)^{1/3} - 170$$
$$= 170(V/200)^{1/3} - 60$$

This equation must be modified to some extent depending on the height of a golfer and the form of a golfer at the time of addressing. However, the effect of the height of a golfer is considerably small because the distance between the eyes and the ball at the time of addressing includes the shaft length. Moreover, the absolute distance between the eyes of a shorter golfer and a ball is shorter than that of a taller golfer when clubs of the same length are used, and this relation has the relative effect compensating the disadvantage in the calculation of reproducibility. Therefore, the effect of the height of a golfer becomes actually negligible.

In accordance with the above equation, the shaft length can be extended to about 127 cm when the head volume is 270 ml. Therefore, the probability of hitting a ball at the sweet area should be maintained when the shaft length of the driver club has a safer value of 120 cm and the head volume is adjusted to 270 ml.

The head volume of the driver club of the present invention is specified as 270 ml or more based on the above reason.

The driver club of the present invention gives the same probability of hitting at the sweet area as that of driver clubs of the conventional persimmon type having head volumes of 200 ml or less when the length of the driver club of the present invention does not exceed the length specified by the above equation by about 5 cm.

Therefore, it is preferable that the shaft length S is in the range expressed by following inequality (C):

$$S \leqq 170\ (V/200)^{1/3} - 55 \qquad \text{(C)}$$

When the shaft length S is smaller, the probability of hitting a ball at the sweet area is greater, but the distance of shot is shorter. Therefore, because a longer distance of shot can be obtained by effectively taking advantage of the head volume, it is more preferable that the shaft length S is in the range expressed by following inequality (H):

$$170\ (V/200)^{1/3} - 65 \leqq S \leqq 170\ (V/200)^{1/3} - 55 \qquad \text{(H)}$$

On the other hand, when the shaft length S is increased while the power of swing of a golfer is kept the same, the speed and the reproducibility of swing are decreased unless the head weight is decreased.

The present inventors studied the upper limit of the length of a club which a golfer having an ordinary power (a grip of about 35) can sufficiently swing by using Driver M having a head weight of 168 g (a product of TSURUYA Co., Ltd., ACCEL I DURALMINE; shaft: 44 inches long and reinforced with carbon fiber; head volume: 300 ml) and Driver N having a head weight of 190 g (a product of SUMITOMO DUNLOP Co., Ltd., TANGENT TITANIUM; shaft: 45.5 inches long and reinforced with carbon fiber; rigidity of the shaft: S and R; head volume: 270 ml).

In the experiment, four types of driver clubs having the lengths of 50 inches (127 cm), 55 inches (140 cm), 57 inches (145 cm), and 60 inches (152 cm) were prepared by adding a shaft reinforced with carbon fiber to the shaft of Driver M, one of the above commercial driver clubs.

The procedures for the addition of the shaft were as follows: a rubber grip at the end of a driver club was removed; the end from which the rubber grip was removed was firmly reinforced by tightly winding a nylon monofilament to the width of 12 mm; the surface of a shaft for extension reinforced with carbon fiber was made rough with sand paper and coated with an adhesive; the shaft for extension was forced into the original shaft tightly by hitting the shaft for extension using a wooden hammer; the obtained combination was left standing for one day to cure the adhesive and to tightly fix both shafts to each other; and then the shaft for the extension was cut to a specific length.

For preparing a shaft of 55 inches or longer, the procedures for the addition was repeated twice, and the shaft was adjusted to a specific length. A rubber grip was fitted to an end of the prepared shaft. A back line made of aluminum was attached to the back side of the surface of the grip shaft, and a commercial grip tape for tennis WET SUPER GRIP (a trade name, a product of YONEX Co., Ltd., made of a polyurethane resin) was wound around the grip shaft over the back line.

Surprisingly, winding the tape of a polyurethane resin or attachment of the back line made the long driver clubs felt very light, and powerful swing was enabled.

The tape made of a polyurethane resin also absorbs sweat and enables firm gripping easily without a glove. As the grip tape used in the present invention, a tape made of a flexible synthetic resin, such as a tape made of flexible polyvinyl chloride or flexible polyethylene, and other tapes can also be used without particular restriction although the tape made of a polyurethane has the advantageous property of absorbing sweat.

Longer clubs were prepared from Driver N, and it was found that a club which was best suitable for a golfer having an ordinary power of swing could be obtained by extending the shaft length to 51 inches in accordance with the above procedures. Similarly to the above extended clubs based on Driver M, a back line was attached and a flexible tape was wound so that the condition was made the same as the condition of the above clubs.

Two driver clubs of 51 inches long which were modified from Driver N and had shafts of rigidity of S and R were tested by several golfers who actually hit balls by these drivers clubs, and it was found that the shaft of rigidity of R and the shaft of rigidity of S could not be distinguished from each other under a blind condition. The weights of the shaft of rigidity of S and the shaft of rigidity of R before the modification were 54 g and 53 g, respectively.

Driver N and a driver club modified from Driver M to the length of 55 inches were attached with a lead weight of 30 g at the grip part and tested. No distinguishable difference in swing was perceived between the clubs attached with the weight and the original clubs having no weight.

It is confirmed from the above results that the rigidity of the shaft or the weight of the grip part (the weight of the end part of the shaft close to the golfer) does not affect the swing.

However, it was found that a greater weight of the other end of the shaft requires a greater power to swing.

When a part of 30 cm at the grip end of the shaft was removed from the clubs of the length of 51 inches which were modified from Driver N having the shaft of rigidity of R and the shaft of rigidity of S, the weights of the remaining shaft were 45 g and 46 g for the shaft of rigidity of R and the shaft of rigidity of S, respectively. When a part of 30 cm at the grip end of the shaft was removed from the club having the length of 55 inches modified from Driver M, the weight of the remaining shaft was 55 g. The weight of the shaft does not affect the swing in either case. The ordinary length of the grip is about 27 cm, and the position of 30 cm from the grip end is outside the grip part.

However, when a club having a shaft which was reinforced with boron fiber and had a length of 50 inches, an original weight of 98 g, and a weight of 75 g after a part of 30 cm at the grip end was removed was used in place of the above modified club, the club clearly required a greater powder to swing and showed more difficulty for reproducing accurate swing in comparison with above clubs modified from Driver M and from Driver N. More specifically, the swing tended to be delayed and a ball tended to go rightward.

Therefore, it is preferable that, in the wood club of the present invention, a shaft obtained after removing a part of 30 cm at the grip end has a weight of 70 g or less, preferably 60 g or less, more preferably 50 g or less.

A club which requires the same powder as that required to swing a club which was modified from Driver N and had a shaft length of 51 inches was selected from the above four types of clubs modified from Driver M in accordance with relative feel of swing by several golfers having an ordinary power who swung each club several times.

The results obtained about the clubs modified from Driver M were as follows: the club having a shaft length of 50 inches was extremely lighter than Driver N; the clubs having a shaft length of 55 inches and a shaft length of 57 inches were slightly lighter than Driver N; and the club having a shaft length of 60 inches required the same power as that required to swing Driver N. Thus, it was found that the power required for swing can be calculated almost from the head weight alone. It was also found that a club which was modified from Driver M and had a shaft length of 55.5 inches could be swung by the same power as that required to swing Driver N when a lead weight of 10 g was attached to the club modified from Driver M.

Therefore, it was concluded that the length which is suitable for a golfer having average power of swing or even power of swing slightly less than average is 150 cm (about 59 inches) for a driver club having a head weight of 168 g and 127.5 cm (about 50 inches) for a driver club having a head weight of 190 g.

Figure 2:
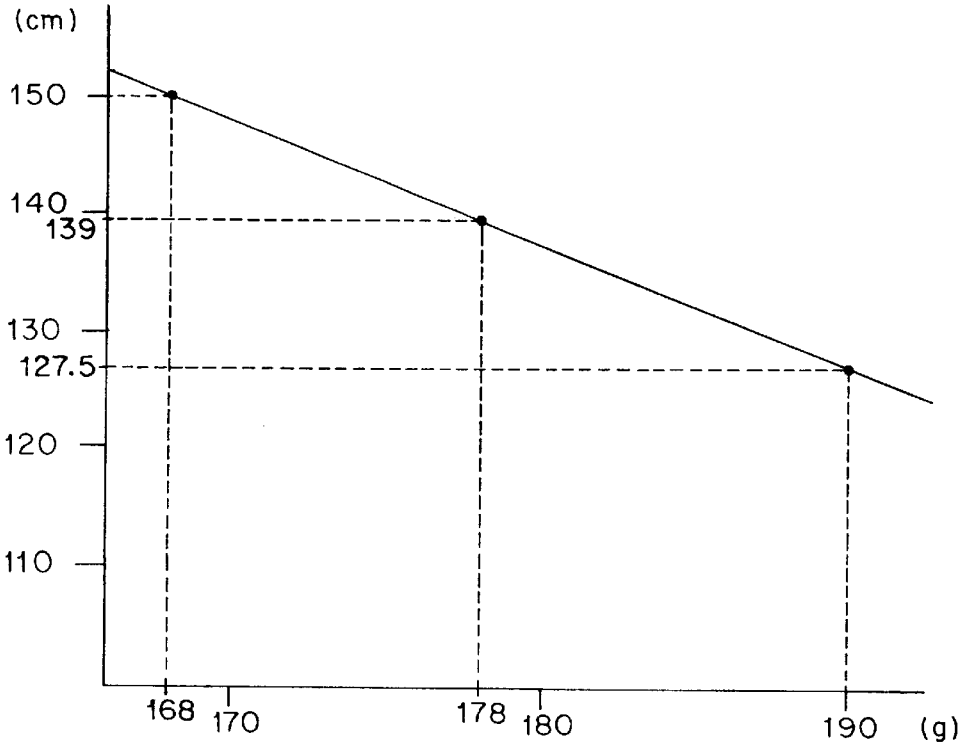
FIG. 2 shows a graph exhibiting the relation between the shaft length and the head weight when a club is swung by a constant power.

Based on these values, the relation of the shaft length and the head weight which enables accurate and powerful swing for an ordinary golfer is expressed by a straight line as shown by FIG. 2.

In accordance with the relation shown in FIG. 2, an extension of the shaft of 2.5 cm has the effect corresponding to an increase in the head weight of about 2.5 g.

From the above figure, the shaft length S (cm) and the head weight G (g) is considered to have a linear relation, which is expressed by the following equation:

$$S=321.8-1.023G$$

Products of the head weight and the shaft length of the above driver clubs can be calculated as follows:

168 g×150 cm=25200 g·cm 190 g×127.5 cm=24225 g·cm

The results of the above calculation show moments of inertia of rotation when the axis of rotation is at the grip end. It can be understood from these numbers that, when the shaft length is in the range of 120 to 150 cm, a club having a smaller weight and a longer shaft does not require more power even when the club has a larger moment of inertia.

Between the above driver clubs, the club having the weight of 168 g has a larger moment of inertia by 4.0% in accordance with the above calculation.

Before the above results were obtained, the present inventors conducted calculations by assuming that clubs which can be swung by the same power have the same moment of inertia.

In accordance with the assumption of the same moment of inertia, the driver club having a head of 168 g would be swung by the same power as that required to swing the other club when the driver club having a head of 168 g had a shaft length of 144 cm (about 57.6 inches).

When the calculation is conducted in accordance with the assumption of the same moment of inertia, the driver club having a head of 168 g would have a length of 57.6 inches as described above. In contrast, when the calculation is conducted in accordance with the equation of the present invention, the driver club having a head of 168 g can have a length of 60 inches. Therefore, the club prepared in accordance with the assumption of the same moment of inertia has a length smaller than that of the club prepared in accordance with the equation of the present invention by 2.5 inches, and a shorter shaft by 2.5 inches corresponds to a shorter distance of shot by about 20 yards.

The axis of rotation is assumed to be at the grip end in the above calculation of the moment of inertia. When the width of the grip is 20 cm and the average grip end is considered to be at the middle of the grip, the axis of rotation can be considered to be at the position of 10 cm from the grip end. When the calculation is conducted taking this into consideration, the above tendency is further enhanced. More specifically, the club having a head of 168 g has the effective shaft length of 140 cm, and the moment of inertia of 23520 g·cm, and the club having a head of 190 g has the moment of inertia of 22325 g·cm. Therefore, the club having a head of 168 g has a larger moment of inertia by 5.3%.

When the width of the grip is taken into consideration and a similar calculation as that described above is conducted, a club which has a head of 168 g and the same moment of inertia as that of a club having a head of 190 g has a shaft length of 142.8 cm (about 57 inches) in accordance with the following equation:

$$(190\times117.5\div168)+10=142.8$$

As shown by the above calculation, a club which can have the shaft length of 60 inches in accordance with the calculation of the present invention has a shorter shaft length by 3 inches when the calculation is conducted in accordance with the assumption of the same moment of inertia.

It is shown by the above calculation that the above equation of the present invention S=321.8−1.023G cannot be thought of by the conventional philosophy of design in which the moment of inertia is the basic concept for the swing weight.

The above difference with respect to the moment of inertia is considered to arise from the fact that actual swing of a golf club is made not simply under the effect of the moment of inertia but under a more complicated condition. For example, the centrifugal force of the head at the impact is supported not only by arms but also by the entire body. Moreover, the weight of a club is actually felt strongly at arms during the period of the addressed position to the top position.

Accordingly, the maximum distance of shot can be obtained while stable reproducibility is maintained when wood clubs having the same swing power are designed in accordance with the above empirical equation S=321.8−1.023G which is proposed in the present invention.

When the range for variation of power by individual golfers is considered to be ±6 cm, more strictly ±3 cm, the shaft length is expressed by the following inequality:

$$315.8-1.023G \leqq S \leqq 327.8-1.023G$$

preferably by following inequality:

$$318.8-1.023G \leqq S \leqq 324.8-1.023G$$

When the shaft length S is smaller than the lower limit, the increase in the distance of shot is not significant. When the shaft length S exceeds the upper limit, the driver club becomes excessively heavy, and the reproducibility of good shot and the head speed are decreased.

In accordance with the physical calculation by the present inventors, an increase or a decrease in the head weight of 15 g increases or decreases, respectively, the initial speed of a ball by about 1 m/sec when the head weight is about 200±20 g, as shown by the above equation.

It was shown by the measurements by the present inventors that an increase in the shaft length of about 2.5 cm increases the head speed by about 1 m/sec. This value corresponds to an increase in the initial speed of a ball of 1.5 m/sec.

Therefore, an increase in the shaft length of 15 cm (about 6 inches) and a decrease in the head weight of 15 g increases the initial speed of a ball by (9−1=8 m/sec).

An increase in the initial speed of a ball of 1 m/sec is considered to correspond to an increase in the distance of shot of about 4 to 5 yards, based on the measurements (The Search for Perfect Swing, Page 163, published by HEINEMAN Inc.)

Therefore, the distance of shot is increased by 30 to 40 yards when the head weight is decreased by 15 g and the shaft length is increased by 15 cm.

In other words, when the shaft length is increased by 15 cm and the head weight is decreased by 15 g in accordance with the philosophy of the present invention, a stable swing can be achieved by the same power of swing, and the distance of shot is increased by about 35 yards.

Figure 3:
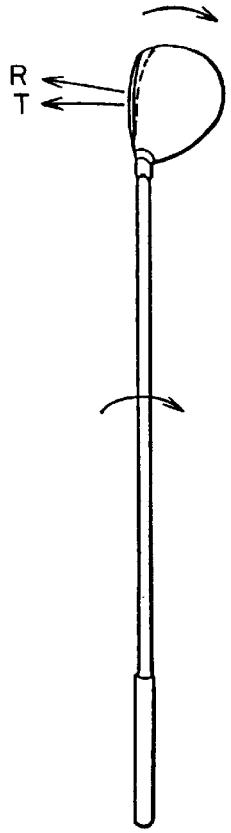
FIG. 3 shows an illustration exhibiting change in the direction of the face of a club, i.e., the direction of flight of a ball, by the change in the angle of the shaft.

As the factor related to the control of the direction of driver shot, the accuracy of the position of the shaft at the moment of impact is important. When the shaft shown in FIG. 3 has a position slightly rotated clockwise at the moment of the impact, the direction of the face is shifted to the rightward direction shown by R from the direction of the target shown by T. However, the position of the shaft remains the same when the shaft length is increased. Therefore, the increase in the shaft length in accordance with the present invention does not decrease the control of the direction of the shot.

Figure 4:
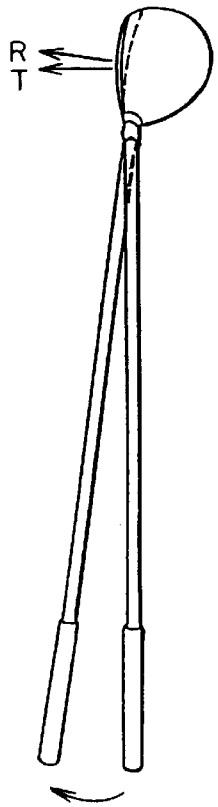
FIG. 4 shows an illustration exhibiting change in the direction of the face of a club by the change in the position of the grip at the time of impact.

In a swing which has the mechanism essentially represented by the swing of a weight attached to an end of a string, such as the swing of a golf club, the direction of the face is varied depending on the position of the grip at the moment of the impact. In FIG. 4, the direction of the face is shifted to the rightward direction R when the position of the grip is shifted leftwards from the original position. The effect of the shift of the position of the grip has a greater range of allowance when the shaft is longer. Therefore, the increase in the shaft length improves the directional control to some extent.

Figure 5:
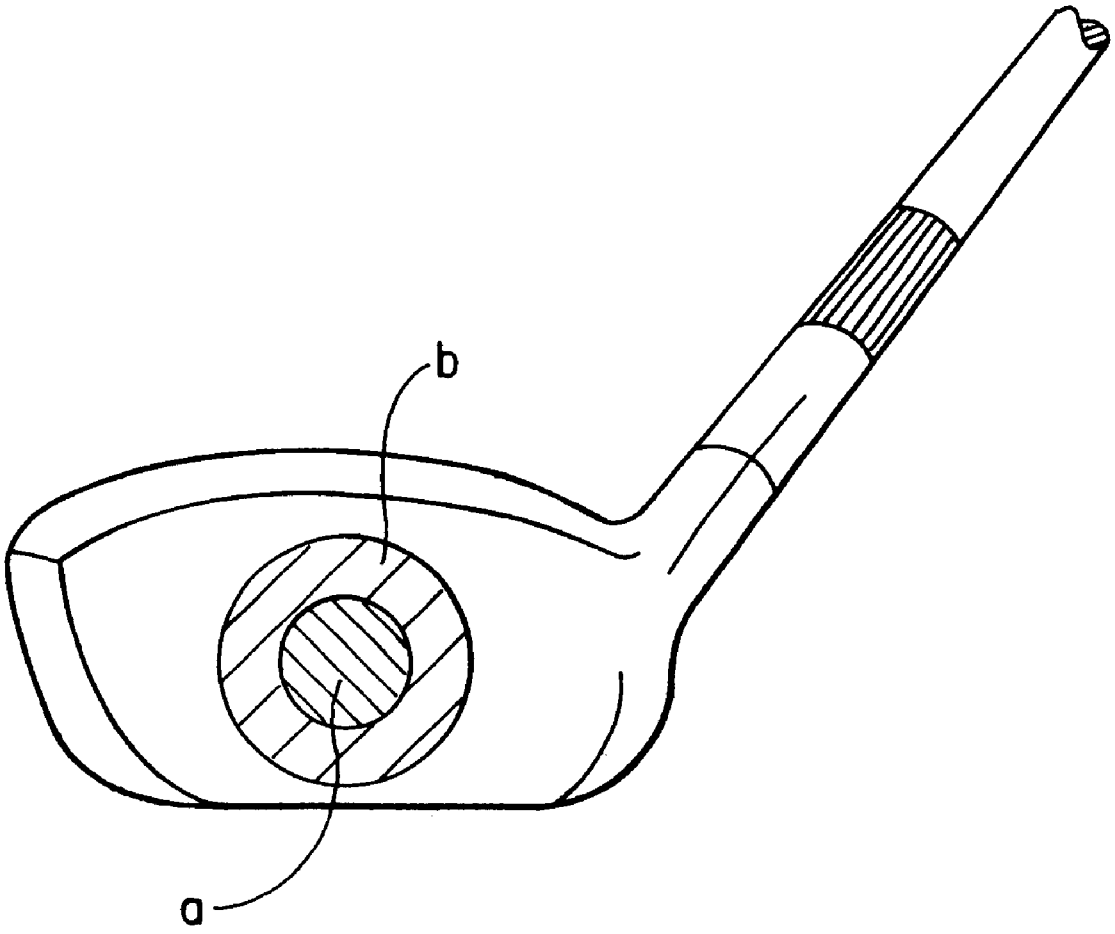
FIG. 5 shows an illustration exhibiting that the sweet area which gives a distance of shot shorter than the maximum distance by 30 yards or less has a diameter twice a diameter of the sweet area which gives the distance of shot shorter than the maximum distance by 10 yards or less.

When the distance of shot is increased by 30 yards by using the driver club of the present invention, the sweet area which gives a distance of shot shorter than the maximum distance by 30 yards or less is an area having the sweet spot at the center and a radius of 2 cm (a diameter of 4 cm, FIG. 5 (*b*)).

In a conventional driver club having a length of 44 inches or less, the sweet area which gives a distance of shot shorter than the maximum distance by 10 yards or less has a diameter of 2 cm (FIG. 5 (*a*)). The above sweet area of the driver club of the present invention is twice as great as the sweet area of the conventional driver club. This means that the driver club of the present invention has a remarkably greater sweet area than that of conventional short driver clubs having the shaft length of 44 inches or less when the comparison is made with respect to the distance of shot.

Therefore, when the distance of shot by the driver club of the present invention is the same as or more than that by a conventional driver club having a length of 44 inches or less, the reproducibility of shot as represented by the size of the sweet area is increased twice or more that obtained by using the conventional driver club.

In other words, the driver club of the present invention provides remarkably more stable shot than the shot obtained by using a conventional driver club having the length of 44 inches when the distance of shot obtained by using the conventional driver club is used as the reference. This considered to mean that the increase in the shaft length increases the sweet area. Thus, surprising results can be obtained that the driver club of the present invention provides a larger distance of shot than that of a conventional driver club having the length of 44 inches when a ball is hit at the sweet spot, and moreover, that an accurate shot is more easily obtained when the distance of shot obtained by using the conventional driver club is used as the reference.

The driver club of the present invention has remarkable advantages in that the probability of hitting at the sweet spot (the size of the sweet area) is not decreased by increasing the shaft length when the evaluation is made on the basis of the probability of hitting at the sweet spot (i.e., when the maximum distance of shot by the long driver club is used as the reference), and that the diameter of the sweet area is increased twice or more that of a driver club having a shaft shorter by 6 inches when the maximum distance of shot by the driver club having a shaft shorter by 6 inches is used as the reference.

One of the remarkable characteristics of the present invention is that the advantage corresponding to increasing the sweet area twice, i.e., corresponding to increasing the head volume 8 times (1600 ml), can be obtained by increasing the shaft length by several inches. Moreover, an increase in the distance of shot of about 30 yards can be obtained when a ball is hit at the sweet spot in the above enlarged sweet area.

The present inventors applied the above philosophy of design of driver clubs to fairway wood clubs.

The fairway wood club of the present invention has a loft angle in the range of 13 to 21 degrees; a face height of 30 to 40 mm, preferably 30 to 36 mm; a head volume V of 150 to 300 ml, preferably 180 to 300 ml, more preferably 200 to 270 ml; a head weight G of 170 to 200 g; and a shaft length of 120 cm or more, preferably 125 cm or more, more preferably 129 cm or more; the shaft length being in the range expressed by following inequality (D):

$$315.8-1.023G \leqq S \leqq 327.8-1.023G \quad \text{(D)}$$

preferably by following inequality (E):

$$318.8-1.023G \leqq S \leqq 324.8-1.023G \quad \text{(E)}$$

In the case of the fairway wood club of the present invention, the probability of hitting at the sweet spot and the control of the direction of shot are remarkably improved because the wood club has a greater loft and the face height is limited to 30 to 40 mm, preferably 30 to 35 mm, in relation to the diameter of a ball of 40 cm.

As the result of the improvement in the probability of hitting at the sweet spot by limiting the loft and the face height, the head volume can be made smaller than that of conventional wood clubs for fairway.

From this standpoint, the lower limit of the head volume of the fairway wood club can be smaller than that of the driver club, i.e., 180 ml or more, preferably 200 ml or more.

In accordance with the same reason, it was found by experiments that the inequalities expressing the range of the shaft length based on the head volume should be modified by replacing the value of 60 at the right side in the inequalities used for the driver club with 45 for the fairway wood club. Therefore, the relation between the head volume and the shaft length can be expressed by the following inequality:

$$S \leqq 170\ (V/200)^{1/3}-45$$

When the range of allowance is formed on the basis of similar equations to those for the driver club, it is preferable that the fairway wood club of the present invention has the shaft length in the range expressed by following inequality (G):

$$S \leqq 170\ (V/200)^{1/3}-40 \quad \text{(G)}$$

preferably by following inequality (J):

$$70\ (V/200)^{1/3}-50 \leqq S \leqq 170\ (V/200)^{1/3}-40 \quad \text{(J)}$$

When a fairway wood club which satisfies the novel condition for the fairway wood club of the present invention is prepared, a wood club which enables easy hitting can be obtained although the shaft length is 120 cm or more.

To summarize the advantages obtained by the present invention, the present invention provides a long driver club and a long fairway wood club which have head volumes of respective specific values or more and can achieve the same probability of hitting at the sweet spot as that obtained by using a shorter club while the distance of shot is remarkably increased by selecting the shaft length in accordance with the head weight in the range expressed by the respective specific inequality.

The driver club of the present invention can give an increased distance of shot, for example, by about 30 yards or more in comparison with a conventional driver club having a shaft shorter by 6 inches.

In the driver club of the present invention, the sweet area which gives a distance of shot shorter than the maximum distance by 30 yards or less has a radius of 2 cm. This means that the driver club of the present invention shows the effect obtained by increasing the dimension of the sweet area twice or more, the area of the sweet area 4 times or more, and the head volume 8 times or more when the distance of shot obtained by a conventional club having a length shorter by 6 inches is used as the reference. In other words, the club of the present invention shows the effect of increasing the sweet area and, at the same time, the effect of increasing the distance of shot by 30 yards when a ball is hit at the sweet spot.

What is claimed is:

1. A golf wood club comprising a shaft and a head at one end of the shaft, the head having a face, and wherein the golf wood club has a loft angle of 16 degrees or less, a face height of 40 mm or more, a head volume V of 270 to 450 ml, a head weight G of 160 to 195 g, and a shaft length S of 120 cm or more, the shaft length S being in the range expressed by the following inequality:

$$315.8-1.023G \leqq S \leqq 327.8-1.023G.$$

2. A golf wood club according to claim 1, which has a shaft length S of 125 cm or more, and a head weight G of 160 to 193 g.

3. A golf wood club according to claim 1, which has a shaft length S of 130 cm or more, a head volume V of 300 to 450 ml, and a head weight G of 160 to 175 g.

4. A golf wood club according to claim 1, which has a shaft length S in the range expressed by the following inequality:

$$318.8-1.023G \leqq S \leqq 324.8-1.023G.$$

5. A golf wood club according to claim 1, which has a shaft length S in the range expressed by the following inequality:

$$S \leqq 170\ (V/200)^{1/3}-55.$$

6. A golf wood club according to claim 1, wherein the shaft has a grip at a grip end portion thereof which is opposite to the head end thereof, and wherein a portion of the shaft, beginning from 30 cm from the end of the grip end portion of the original shaft, has a weight of 70 g or less.

7. A golf wood club according to claim 5, wherein the shaft has a grip at a grip end portion thereof which is opposite to the head end thereof, and wherein a portion of the shaft, beginning from 30 cm from the end of the grip end portion of the original shaft, has a weight of 70 g or less.

8. A golf wood club comprising a shaft and a head at one end of the shaft, the head having a face, and wherein the golf wood club has a loft angle in the range of 13 to 21 degrees, a face height of 30 to 40 mm, a head volume V of 150 to 300 ml, as head weight G of 170 to 200 g, and a shaft length S of 120 cm or more, the shaft length S being in the range expressed by the following inequality:

$$315.8-1.023G \leqq S \leqq 327.8-1.023G.$$

9. A golf wood club according to claim 8, which has a shaft length in the range expressed by the following inequality:

$$318.8-1.023G \leqq S \leqq 324.8-1.023G.$$

10. A golf wood club according to claim 8, which has a shaft length in the range expressed by the following inequality:

$$S \leqq 170\ (V/200)^{1/3}-40.$$

11. A golf wood club according to claim 8, wherein the shaft has a grip at a grip end portion thereof which is opposite to the head end thereof, and wherein a portion of the shaft, beginning from 30 cm from the end of the grip end portion of the original shaft, has a weight of 70 g or less.

12. A golf wood club according to claim 10, wherein the shaft has a grip at a grip end portion thereof which is opposite to the head end thereof, and wherein a portion of the shaft, beginning from 30 cm from the end of the grip end portion of the original shaft, has a weight of 70 g or less.

* * * * *